US007628053B2

(12) United States Patent
Bermudez, III

(10) Patent No.: US 7,628,053 B2
(45) Date of Patent: Dec. 8, 2009

(54) GRAPHIC ARTS DIE PLATE HOLD-DOWN DEVICE

(75) Inventor: Pedro Jose Bermudez, III, Olathe, KS (US)

(73) Assignee: Infinity Foils, Inc., Overland Park, KS (US)

( * ) Notice: Subject to any disclaimer, the term of this patent is extended or adjusted under 35 U.S.C. 154(b) by 751 days.

(21) Appl. No.: 11/446,671

(22) Filed: Jun. 5, 2006

(65) Prior Publication Data

US 2007/0277583 A1 Dec. 6, 2007

(51) Int. Cl.
*B21K 5/12* (2006.01)
*B26D 7/26* (2006.01)
*B26F 1/44* (2006.01)

(52) U.S. Cl. ..... 72/481.6; 72/481.7; 72/481.8; 72/481.9; 72/482.94; 83/699.11; 83/698.41; 83/698.42; 76/107.8; 411/54; 411/54.1; 411/55; 101/389.1

(58) Field of Classification Search ..... 72/481.1, 72/481.3, 481.4, 481.5, 481.6, 481.7, 481.8, 72/481.9, 482.94; 83/699.11, 698.41, 698.42; 76/107.8; 411/54, 54.1, 55; 101/28, 32, 101/34, 389.1, 401.1, 454, 458, 465
See application file for complete search history.

(56) References Cited

U.S. PATENT DOCUMENTS 509,075 A * 11/1893 Fietsch ..... 101/385
873,303 A * 12/1907 Dohrmann ..... 101/385
1,382,151 A 6/1921 Wamock
1,418,112 A 5/1922 Wamock
1,529,847 A 3/1925 Pitt
1,547,473 A 7/1925 Wamock
1,554,123 A 9/1925 Noell
1,573,429 A 2/1926 Thiel
1,729,412 A * 9/1929 Andrews ..... 101/385
1,839,464 A 1/1932 Brugman
1,955,933 A 4/1934 Roesner (Continued)

*Primary Examiner*—David B Jones
(74) *Attorney, Agent, or Firm*—Hovey Williams LLP

(57) ABSTRACT

A hold-down device is provided for securing graphic arts die plates or die to flat bed or rotary chases having a series of generally cylindrical, hold-down device-receiving cavities. The chase cavities have an innermost portion of greater diameter than the outermost portion of the cavity, presenting a downwardly-facing shoulder therebetween. The device, which is adapted to be inserted in one of the cavities, has a pair of opposed, generally semi-circular anchor members. A fulcrum component positioned between the anchor members has a generally circular fulcrum section received in respective, opposed internal grooves in the anchor members. A lock ring that interconnects the ends of the members remote from the fulcrum section, biases those ends toward one another. When the device is installed in a cavity, the ends of the anchor members are forced toward one another to an extent that the device will fit within the outermost portion of the cavity. Insertion of the device into the cavity is continued until the ends of the anchor members remote from the lock ring are able to move outward relatively into underlying relationship with the shoulder of the cavity. The lock ring serves to maintain the uppermost ends of the anchor members in engagement with the shoulder of the cavity. The device can be removed from the cavity at any time by use of a tool that moves the upper ends of the anchor members toward one another to an extent clearing the cavity shoulder so that the device can then be pulled out of the cavity.

13 Claims, 1 Drawing Sheet

U.S. PATENT DOCUMENTS 2,283,587 A * 5/1942 Steinbach ..... 101/211
2,370,327 A 2/1945 Rosan
2,448,351 A 8/1948 Brush
2,520,928 A 9/1950 Hall
3,797,351 A * 3/1974 Jones, Jr. ..... 83/699.11
4,135,432 A 1/1979 Schalge et al.
4,259,890 A 4/1981 Walsh
4,449,877 A 5/1984 Kessler
4,986,711 A * 1/1991 Fischer ..... 411/55
5,090,857 A * 2/1992 Dunn ..... 411/385
5,135,341 A 8/1992 Leyder
5,181,816 A 1/1993 Walsh
5,520,080 A * 5/1996 Sandford ..... 83/698.51
5,634,754 A * 6/1997 Weddendorf ..... 411/354
5,846,041 A * 12/1998 Bevan et al. ..... 411/65
6,341,557 B1 * 1/2002 Hutchison et al. ..... 101/389.1
6,658,978 B1 * 12/2003 Johnson ..... 83/699.11
7,096,709 B2 * 8/2006 Hutchison et al. ..... 72/482.94

* cited by examiner

GRAPHIC ARTS DIE PLATE HOLD-DOWN DEVICE

BACKGROUND OF THE INVENTION

1. Field of the Invention

This invention relates to a hold-down device for securing a die or die support plate to the flat bed or rotary chase of a graphic arts press. In particular, the invention concerns a hold-down device adapted to be positioned in a respective cavity of a chase and that has a removable component that engages and reliably secures a graphic arts die or die support plate in predetermined disposition on the chase.

2. Description of the Prior Art

Hot foil stamping and embossing graphic arts presses have a flat or rotary chase provided with a plurality of cavities in predetermined relative relationship. These chases are adapted to support one or more of the hot foil and/or embossing dies. Various toggle devices have long been provided for securing the dies to a respective chase in predetermined relative disposition. Prior toggle devices have been constructed to be removably received in a chase cavity, are operable to be locked in position, and include some type of gripper for engaging an edge portion of the die. A multiplicity of the toggle devices have been used around the perimeter of each graphic arts die and that have some type of fastener engageable with a central portion of the die or a support for a die that is secured to the chase.

One type of conventional toggle fastener or hook has two end-to-end pieces that are telescopically received in a chase cavity and that have interengaging inclined surfaces. Mechanism forming a part of the toggle fastener is adapted to receive a tool such that, as a result of manipulation of the tool, the two pieces of the fastener are drawn toward one another, thereby expanding the device as the inclined surfaces shift relatively whereby the die is locked in the cavity. A die-engaging element of the toggle fastener, which projects outwardly from a respective cavity when a fastener is installed, contacts an edge or surface of a die plate mounted on the chase. By providing a plurality of the toggle fasteners around the perimeter of a die or die support plate, the graphic arts die or die plate can be fixedly mounted on either a flat bed or rotary graphic arts press chase.

Toggle fasteners heretofore available have been relatively expensive to manufacture and sell for premium prices. The fasteners were complicated, did not always accomplish their intended holding function, and were prone to breakage and damage. Several hundred of the fasteners were required for jobs in which a substantial number of dies were directly mounted on a single chase platen. It, therefore, was not only costly for press operators to purchase and then rely on these prior art devices for die makeready procedures, but equally as important, it was time consuming and expensive because of the substantial hours that were required for press operators to install the large number of toggle fasteners required for jobs involving a multiplicity of dies on each press chase, and to go through conventional makeready adjustments. Similarly, removal of the toggle fasteners for change out of dies involved significant expenditures of time. As development of toggle fasteners evolved, the fasteners became ever more complicated and therefore more expensive and difficult to install and remove.

Because the edge of a die plate, or a plate supporting a plurality of dies, frequently partially covered the closest chase openings when the die or die plate was positioned in a desired location on a flat bed or rotary chase, it was not possible to insert and utilize hold-down fasteners in the most advantageous locations. In addition, previously available toggle devices were often not usable in different sizes of cavities in flat bed or rotary press chases depending on the type of chase on a particular press.

SUMMARY OF THE INVENTION

This invention relates to a hold-down device for securing a graphic arts die or die support plate to a flat bed or rotary chase. Conventional chases typically have a series of cavities that are essentially round in cross-section. These cavities generally have an innermost section of larger cross-sectional diameter than the outermost section of the cavity, thereby presenting a circular shoulder that faces away from the surface of the chase. The present hold-down device is adapted to be inserted in a selected cavity and, upon insertion, is automatically held in a fixed position by virtue of the fact that the device releasably engages the proximal surface of a cavity shoulder. A removable fastener received in the hold-down device is adapted to engage a graphic arts die or die support plate on the chase and assists in fixing the die or die support plate in a predetermined position on the chase.

The hold-down device has a pair of opposed anchor members having generally semi-circular outer faces configured to complementally engage the wall surface of a respective chase cavity. A fulcrum component that is of T-shaped cross-sectional configuration is positioned between the anchor members and has a fulcrum section that engages opposed inner surfaces of the anchor members. The anchor members are pivotal about the fulcrum section with opposite ends of the members being movable toward and away from one another.

The outer surfaces of the anchor members are provided with semi-circular, aligned grooves that pivotally receive a resilient element interconnecting the members and positioned in closer relationship to the ends of the members remote from the outer surface of the chase, than opposed ends of the members. The resilient element, which is preferably a spring steel lock ring, is operable to bias the innermost ends of the anchor members toward one another, while biasing the outermost ends of the anchor members away from each other in disposition engaging the shoulder of a cavity. Engagement of the upper ends of the anchor members with the downwardly-facing shoulder of a respective cavity prevents withdrawal of the device from the cavity until the upper ends of the members are moved toward one another to an extent that the upper ends of the members clear the shoulder, thus permitting removal of the device from the cavity. The hold-down devices of this invention offer more secure fastening of a die or die supporting plate to any one of a variety of flat bed or rotary press chases than heretofore available toggle holders. Improved fastening is in part attributable to the better fit of the holding device in a respective chase cavity.

The fulcrum component has a central threaded passage that communicates with the outer surface of the chase. A fastener that preferably comprises a socket button head screw is removably threaded into the passage. The enlarged head of the socket button head screw, positioned above the surface of the chase, is adapted to engage and thereby assist in holding a graphic arts die or die support plate on the chase.

In the past, graphic arts dies have been placed on a chase in approximate positions, fastened down, material run through the press to determine alignment of the image on the die surface with the artwork image on the stock being processed, and the dies then adjusted as many times as necessary to accomplish alignment of the dies with the artwork images. Because the cavities in press platens are in predetermined positions one with respect to another, the axes of those cavities can be represented by X-Y coordinates in an appropriate data table. Often, the supplier of the dies will know or can determine the relative spacing of the chase cavities from the type of chase the press operator intends to use. X-Y coordinate data can thus be generated regarding the cavity spacing. Alternatively, if the die supplier does not know what the cavity spacing is of a particular chase to be used by the press operator, that information can be supplied by the press operator in the form of X-Y coordinates. The cavity coordinate data can then be used by the die fabricator for drilling of holes in the dies or die support plates in precise positions with respect to the die image on single dies, or the die images on multiple dies carried by a particular die plate, and for determining which cavities of the chase should have hold-down devices. Because the diameter of the holes for receiving the socket button head screws is only slightly larger than the diameter of the threaded shanks of the screws, only limited movement of the dies or die plates is permitted with respect to the chase on which they are mounted. Accordingly, this arrangement can significantly reduce and in many instances virtually eliminate the trial and error, multiple step die adjustment processes presently required in press makeready.

Most standard graphic arts press chases have smooth bore cavities for receipt of die or die plate holder devices. Recent chases have alternate threaded and smooth bore cavities. The provision of threaded cavities allows a press operator to thread screws into the threaded cavities for securing dies or die plates to the chase. One difficulty with this arrangement is the fact that the dies must be arranged on the chase in disposition that to a certain extent is controlled by the positions of the threaded openings, if the operator wants to take advantage of the multiplicity of threaded cavities for receiving screws that can be used to assist in securing the die or die plate to the chase.

The hold-down devices of the present invention allow a graphic arts press operator to convert a standard smooth bore cavity platen to a chase that has either selected smooth bore cavities converted to what amounts to threaded cavities, or to convert all of the smooth bore cavities of the chase to the threaded cavity form of chase in which the cavities are adapted to receive screws or bolts to assist in securing dies or die plates to the chase. In this instance, the positions of the hold-down devices, one with respect to another, may be preselected based on an X-Y database or known chase cavity location to assist in preparing dies or die plates having holes for receiving bolts or socket button head screws that thread into a predetermined threaded cavity, again substantially decreasing die makeready adjustments.

DETAILED DESCRIPTION OF THE PREFERRED EMBODIMENT

Figure 1:
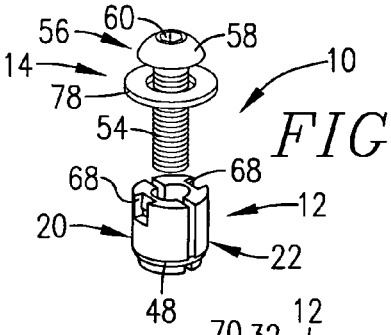
FIG. 1 is an approximately actual size perspective view of the hold-down device of this invention, with the socket button head screw in disposition for insertion into the main body unit of the device.
Figure 3:
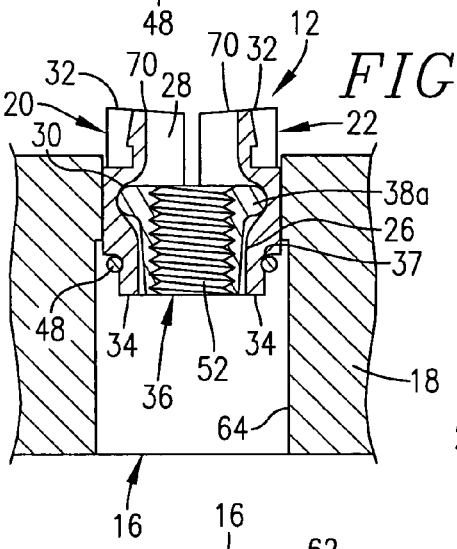
FIG. 3 is an enlarged fragmentary cross-sectional view of the main body unit of the hold-down device partially inserted in a cavity of a graphic arts press chase.
Figure 2:
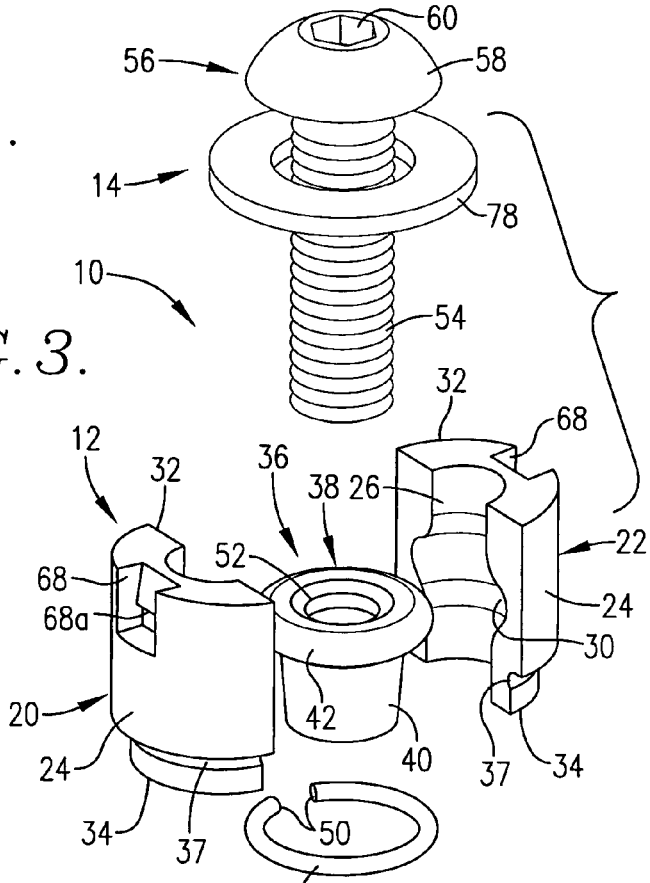
FIG. 2 is an enlarged exploded view of the hold-down device.

The hold-down device 10 for securing a graphic arts die plate to a press chase includes a main body unit 12 and a fastener 14. Device 10 is adapted to be inserted in a cavity 16 of a graphic arts press chase 18. As depicted in FIGS. 1 and 2, main body unit 12 of device 10 includes a pair of opposed, generally semi-cylindrical anchor members 20 and 22, each of which has a semi-circular outer face 24. The internal, generally semi-cylindrical surfaces 26 of anchor members 20 and 22 face one another and cooperate to define an internal passage 28 extending the full length of main body unit 12. As best shown in FIGS. 2 and 3, each of the anchor members 20 and 22 has a circumferentially-extending, semi-circular groove 30 intermediate the upper end 32 and the lower end 34 of the anchor members 20 and 22.

A fulcrum component 36 that is of T-shaped cross-sectional configuration is interposed between the anchor members 20 and 22 of main body unit 12. Viewing FIGS. 2 and 3, the fulcrum section 38 of component 36 has an enlarged circular head segment 38*a* that is unitary with a tapered post segment 40 depending from head segment 38*a*. The outer, circumferentially-extending, circular surface 42 of head segment 38*a* is configured to be complementally received in the opposed aligned grooves 30 of anchor members 20 and 22. As is evident from FIG. 3, the diameter of head segment 38*a* of fulcrum component 36 is such that the component 36 maintains anchor members 20 and 22 in spaced relationship in the assembled condition of main body unit 12.

The lower margins 34 of anchor members 20 and 22 are stepped back from the faces 24 of anchor members 20 and 22 and are provided with semi-circular, aligned recesses 37 that receive a circular spring steel lock ring 48. Opposed ends 50 of lock ring 48 are spaced from one another whereby ring 48 biases the ends 34 of anchor members 20 and 22 toward one another.

Fulcrum component 36 is provided with an elongated, threaded, internal central passage 52 extending through the head segment 38*a* and post segment 40 of the fulcrum component 36. Fastener 14 preferably comprises a socket button head screw 56. The passage 52 in component 36 is adapted to complementally receive the threaded stem portion 54 of the socket button head screw 56 that has a head portion 58 provided with a central, transversely polygonal socket 60.

Figure 5:
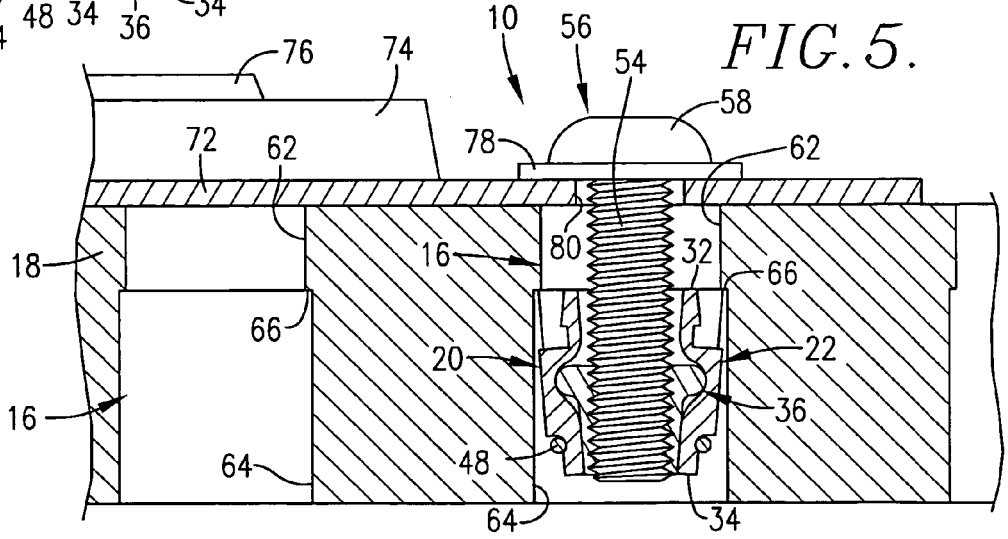
FIG. 5 is a fragmentary generally schematic cross-sectional view illustrating the hold-down device inserted in a chase cavity in disposition engaging and assisting in holding a graphic arts die plate on the chase.

Apertured chases forming a part of flat bed and rotary graphic arts presses especially adapted for substrate processing operations that include hot foil stamping, embossing, or combinations thereof, are conventionally provided with a series of spaced, generally cylindrical cavities 16, as schematically shown in FIG. 5. Typically, the outermost cylindrical section 62 has a diameter of about 0.4 in., the diameter of the larger interior cylindrical section 64 is 0.45 in., thereby presenting a downwardly-facing, interior, circular shoulder 66. The distance from the outer surface of the chase to shoulder 66 may, for example, be about 0.2 in., with the depth of interior section 64 being about 0.5 in. The diameter of main body unit 12 with the anchor members 20 and 22 thereof being essentially parallel, should be about 0.006 in. less than the diameter of cylindrical section 62 of cavity 16.

The upper ends 32 of anchor members 20 and 22 are provided with outwardly-facing notches 68 that are open at the upper surfaces of ends 32, and have innermost, outwardly directed ledge portions 68*a*. It is preferred that the faces 70 of ends 32 of anchor members 20 and 22 be inclined inwardly as shown in FIG. 3.

Figure 4:
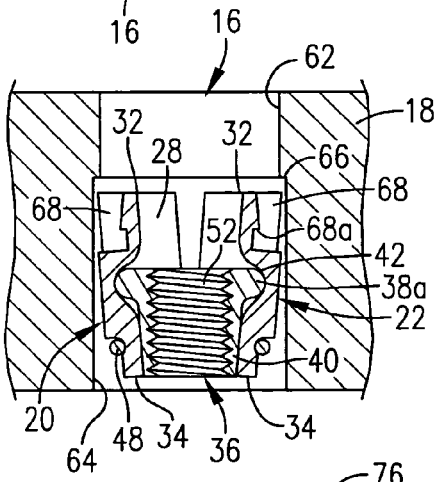
FIG. 4 is an enlarged fragmentary cross-sectional view of the main body unit of the hold-down device in its locked position in the cavity of a graphic arts press chase, with the upper margins of the semi-circular anchor members of the device engaging a downwardly-facing shoulder of the cavity.

In operation, the main body unit 12 minus socket button head screw 14 is inserted in a cavity 16 by the user grasping the ends 32 of anchor members 20 and 22 between two fingers and exerting a compressive force to move the ends 32 toward one another against the bias of spring steel lock ring 48 as the anchor members 20 and 22 pivot about the fulcrum section 38 of fulcrum component 36. After the main body unit 12 is partially inserted in the cavity 16 as shown in FIG. 3, the compressive force on the upper ends of anchor members 20 and 22 may be released. The outer surface 24 of the upper portions of anchor members 20 and 22 engage and slide along the inner cylindrical face of section 62 of cavity 16 against the bias of lock ring 48. Insertion of main body unit 12 of device 10 is continued until the upper ends 32 of anchor members 20 and 22 are permitted to move away from one another under the bias of spring steel lock ring 48 into disposition underlying shoulder 66, as illustrated in FIG. 4. Because the upper faces 70 of anchor members 20 and 22 are inclined inwardly toward one another, as best shown in FIG. 3, when the ends 32 of anchor members 20 and 22 move away from one another below shoulder 66 under the bias of lock ring 48, the upper faces 70 of anchor members 20 and 22 substantially complementally engage the downwardly-facing surface of shoulder 66.

Although it is contemplated that the individual hold-down devices 10 will be permanently installed in respective cavities 16 in either a flat chase or a rotary chase, in the event the press operator desires to remove a particular hold-down device 10 for any reason, including relocation of the device, each hold-down device may be readily removed from its cavity. Removal is accomplished by inserting the legs of a bifurcated pincer tool having inwardly directed jaws on the lower extremities thereof, into the notches 68. Application of compressive force on the legs of the removal tool causes the jaws to grip the ledge portions 68*a* within notches 68 of anchor members 20 and 22 and to rotate the upper ends 32 thereof toward one another, against the bias of lock ring 48, to an extent causing the ends 32 to clear the shoulder 66 so that the device 10 can then be readily removed from the cavity 16. The device 10 that has been removed from a cavity can either be placed in another cavity, or returned to the cavity from which it was initially removed.

The distance from the outermost design-defining surface 76 of die 74 to the outermost face of plate 72 may typically be about 0.19 in. The thickness of the head portion 58 of a preferred socket button head screw 14 is about 0.108 in. Using a washer 78 having a thickness of about 0.04 in., the total height of washer 78 and head 58 will equal about 0.148 in., which is less than the 0.19 in. thickness of die 74, thus assuring that the button head 58 of screw 14 does not interfere with the design image of die 74.

The press operator generally furnishes an artwork image film to the die supplier that is then used by the supplier to prepare dies having die surfaces that correspond to respective images on the master film. The die supplier is then required to prepare dies that have die images that match the artwork images on the film master. Because the die images must register with the artwork images on a substrate passed through the press, it is necessary that the dies be in precise registration with respective artwork images.

Hold-down devices 10 can advantageously be used to secure either a single die to a flatbed chase or a rotary chase, or a support plate that carries a plurality of dies. If the job calls for a number of individual dies to be directly secured to a chase with the die surfaces in alignment with images on a substrate processed by a press, X-Y coordinate data with respect to the location of the cavities of the specific chase may be used to establish where holes are to be drilled in each die for receipt of a respective screw 56 that is to be threaded into a corresponding hold-down device 10. If the die supplier has appropriate X-Y coordinate data available with respect to the location of cavities in the chase to be used by the press operator, or the die supplier can prepare an X-Y coordinate table from known relative locations of the chase cavities, that coordinate data may be used to establish where at least two spaced holes are to be drilled, and then proceed to drill the requisite holes, in each individual die or die support plate. The die image will then relatively precisely align with a respective artwork image when the die is mounted on the chase using screws passing through respective holes and threaded into hold-down main body units in specified cavities. In the event the die supplier does not have information with respect to the location of cavities in a particular chase, the hole locations necessary to generate X-Y coordinate data can be obtained from the press operator. This data is then used to locate the relative position of holes to be drilled in the dies.

In the case where a plurality of dies are to be mounted in predetermined disposition on a die support plate, preferred structure for securing multiple dies to a single support plate is disclosed in the assignee's application Ser. No. 11/109,605, filed Apr. 20, 2005, entitled Graphic Arts Die and Support Plate Assembly, now U.S. Pat. No. 7,096,709, which is incorporated herein by specific reference thereto. In accordance with that invention, a die support plate 72 is provided that mounts a series of design-defining dies 74. The support plate with a plurality of dies thereon is adapted to be placed over the chase 18, preferably in a predetermined disposition with respect to those cavities 16 of the chase that are to be provided with hold-down devices 10 as determined by the X-Y coordinate matrix of the chase cavities. The die support plate 72 has X-Y coordinate-derived pre-drilled holes 80 for receipt of the stem portion 54 of a respective socket button head screw 56. It is to be understood in this respect that the holes drilled in the die support plate are preferably of a diameter approximately equal to the diameter of the stem portion 54 of a respective screw 56 so that there limited play between the die plate and the screw carried by the main body unit of a respective hold-down device. The difference between the diameter of stem portion 54 of each screw 56 and the opening 80 in die plate 72, for example, may be of the order of 0.030 in. The same amount of latitude can be provided between stem portion 54 of screw 56 and a die mounted directly on a flat bed or rotary chase. The stem of the screw 56 having a washer 78 thereon, inserted through the hole 80 prepared therefor in die support plate 72 is threaded into the passage 52 of component 36. Rotation of screw 56 by a suitable allen wrench inserted in socket 60 is continued until the combination of washer 78 and head portion 58 of screw 56 is snugged down against the upper face of die support plate 72. Provision of washer 78 is preferred so that during final rotation of screw 56, the head portion 58 thereof does not impart rotational forces to the die plate 72. The same procedure would be followed in affixing a die to the surface of the flat bed or rotary graphic arts press chases.

In order to most expeditiously accomplish the foregoing, the chase cavity X-Y coordinate data is employed to establish precisely where holes 80 are to be drilled in individual dies or in the support plate 72. Based on that X-Y cavity location coordinate data, a CNC machine or the like is programed to drill holes 80 in support plate 72 or in the body of a die that receive screws 56 threaded into main body unit 12 of each respective hold-down device 10. The computer program for the CNC machine, using the X-Y chase cavity coordinate data, calculates where holes are to be drilled in predetermined positions in the support plate 72 or die so that screws passing through each hole will align with and be received in hold-down devices in corresponding chase cavities, with the design faces of the dies in precise alignment with the artwork images. In the event the hold-down devices 10 are not provided in all of the chase cavities, the die supplier can provide a film to the press operator that contains the artwork images and also marks, such as crosses, x's or the like, indicative of the chase cavities that should be provided with hold-down devices 10 for receipt of screws passing through the holes drilled in die support plates 72 or die. By laying that film over the chase, the press operator will readily understand where individual hold-down devices 10 should be inserted in particular chase cavities.

I claim:

1. A hold-down device for securing a graphic arts die or die support plate to a chase having an outer surface and provided with a series of cavities that are generally round in cross-section and each having a shoulder facing away from the outer surface of the chase, said device comprising:

a main body unit having a pair of opposed anchor members having generally semi-circular outer faces being configured to be received in a respective cavity, with one set of ends of the members in closer relationship to said outer surface of the chase than the other set of ends of the members, a fulcrum component between the anchor members of the main body unit and having a fulcrum section engaging opposed inner surfaces of the anchor members intermediate opposed ends of the members, said members being pivotal about the fulcrum section with the opposite ends of the members being movable toward and away from one another, a resilient element interconnecting the members and positioned in closer relationship to said other set of ends of the members than said one set of ends of the members, said element being operable to bias said other set of ends toward one another and said one set of ends of the members away from one another, said one set of ends of the members being engageable with the shoulder to prevent withdrawal of the device from a respective cavity until said one set of ends of the members are moved out of engagement with said shoulder, said fulcrum component having a central threaded passage communicating with the outer surface of the chase; and a fastener removably threaded into the passage of the component, said fastener having an enlarged section outboard of the outer surface of the chase that is adapted to engage and assist in holding a graphic arts die or die support plate on the chase.

2. A hold-down device as set forth in claim 1, wherein the fulcrum section of said fulcrum component has a head segment of generally circular configuration, said anchor members having semi-circular grooves pivotally receiving opposed portions of the head segment of the fulcrum section.

3. A hold-down device as set forth in claim 1, wherein said fulcrum component has a post segment, said threaded passage extending through the head and post segments of the fulcrum component.

4. A hold-down device as set forth in claim 1, wherein said outer faces of the anchor members are provided with semi-circular aligned recesses, said element being received in the recesses.

5. A hold-down device as set forth in claim 1, wherein said element is a spring steel lock ring.

6. A hold-down device as set forth in claim 1, wherein said one set of ends of the members are provided with opposed notches for receipt of a tool operable to move said one set of ends of the member toward one another against the bias of said element to an extent permitting removal of the device from a respective cavity.

7. A hold-down device as set forth in claim 1, wherein said fastener is a socket button head screw button head screw.

8. A hold-down device as set forth in claim 1, wherein each of said cavities has a bottom and said anchor members of the hold-down device are of a length when installed to engage the bottom of a respective cavity.

9. A hold-down device as set forth in claim 1, wherein said one ends of the members are of generally planar configuration.

10. A hold-down device as set forth in claim 1, wherein said fulcrum component is of substantially T-shaped cross-sectional configuration.

11. A hold-down device as set forth in claim 1, wherein said device is of sintered metal.

12. A method of securing a graphic arts die or die support plate having a plurality of dies, each provided with a design-defining surface, to a chase provided with a series of cavities in predetermined spaced relationship, with the design-defining die surfaces being aligned with artwork images on a substrate, said method comprising the steps of:

providing a hold-down main body unit in each of a plurality of chase cavities;

drilling a series of holes in a die or die support plate corresponding to X-Y coordinate data representative of the relative spatial locations of certain of the cavities, one with respect to another, and providing a screw for each main body unit, each of the screws having a stem portion, introducing the stem portion of the screws through the holes in the die or die support plate and threading the stem portion into respective hold-down main body units in the chase cavities to secure the die or die support plate to the chase, the stem portion of the screws being of a diameter substantially equal to the diameter of a receiving hole, the individual holes being drilled in the die or die support plate in dispositions based on the X-Y coordinate data such that when the dies or die support plates are affixed to the chase with the fasteners extending through corresponding holes and into respective hold-down main body units, the design-defining surfaces of the graphic arts dies are precisely aligned with respective artwork images.

13. The method of claim 12, wherein is included the step of preparing a graphical overlay representation where the hold-down main body units are to be provided in respective cavities of the chase, and providing hold-down main body units in at least the cavities established by the overlay representation.

* * * * *